US005451916A

United States Patent [19]

Kobayashi

[11] Patent Number: 5,451,916

[45] Date of Patent: Sep. 19, 1995

[54] WAVEGUIDE

[75] Inventor: Hideki Kobayashi, Tokyo, Japan

[73] Assignee: NEC Corporation, Japan

[21] Appl. No.: 230,830

[22] Filed: Apr. 21, 1994

[30] Foreign Application Priority Data

Apr. 22, 1993 [JP] Japan ..... 5-117617

[51] Int. Cl.[6] ..... H01P 3/14

[52] U.S. Cl. ..... 333/239; 333/33; 333/35; 333/241

[58] Field of Search ..... 333/33, 35, 208, 239, 333/241, 248, 253

[56] References Cited

U.S. PATENT DOCUMENTS

| | | | |
|---|---|---|---|
| 2,438,914 | 4/1948 | Hansen | 333/33 |
| 2,510,022 | 5/1950 | Korman et al. | 333/33 |
| 2,555,118 | 5/1951 | Cogle et al. | 333/241 |
| 2,956,247 | 10/1960 | Sfgerrazza | 333/35 X |
| 3,309,626 | 3/1967 | Higgins | 333/253 X |

FOREIGN PATENT DOCUMENTS 57-62403 9/1980 Japan .

OTHER PUBLICATIONS

Southworth, *Principles and Applications of Waveguide Transmission,* Van Nostrand Co. Princeton, N.J., 1950, p. 240 relied on; Copy in A.Y. 2502, QC661568.

*Primary Examiner*—Paul Gensler

*Attorney, Agent, or Firm*—Ostrolenk, Faber, Gerb & Soffen

[57] ABSTRACT

A waveguide according to this invention has a waveguide portion used in transmission in a relatively low frequency band, and a stub circuit portion, connected in series with the waveguide portion, for achieving impedance matching. Since the waveguide for the relative low frequency band, i.e., a frequency band equal to or lower than 40 GHz, has a large aperture size, it has a sufficient mechanical strength even in a use in a satellite. When the stub circuit portion is connected in series with the waveguide, the impedance of the waveguide can be improved, and sufficient transmission performance can be attained even in a millimeter wave frequency band equal to or higher than 40 GHz.

19 Claims, 6 Drawing Sheets d=0.2mm, a=5.7mm, L=4.3mm

WAVEGUIDE

BACKGROUND OF THE INVENTION

1. Field of the Invention

The present invention relates to a waveguide as a transmission medium of an electromagnetic wave and, more particularly, to a waveguide for a millimeter wave frequency band or higher, which has a mechanical strength high enough to be mounted in a satellite.

2. Description of the Prior Art

Devices mounted in a satellite must have a mechanical strength high enough to withstand vibrations upon launching of a rocket, a shock upon separation of a booster, and the like, unlike those used on the earth. In general, such devices are required to have a mechanical strength high enough to withstand a random wave vibration level of 19.6 grms. For this reason, even a waveguide as a transmission medium of a radio wave adopts a flexible waveguide with flexibility, as disclosed in Japanese Utility Model Laid Open No. 57-62403.

FIGS. 1 and 2 are respectively a perspective view and a sectional view of a conventional flexible waveguide assembly.

As shown in FIGS. 1 and 2, a flexible waveguide assembly comprises a flexible waveguide 101, and rectangular waveguides 102 and 103, and waveguide flanges 104 and 105, which are connected to the two ends of the flexible waveguide 101. This prior art exemplifies a waveguide used in a frequency band from 26.5 to 40 GHz, and the dimensions of the waveguide are a long side a=7.1 mm, and a short side b=3.55 mm.

The aperture size of the waveguide becomes smaller as the transmission frequency becomes higher. For example, in the frequency band from 26.5 to 40 GHz like in the prior art, the dimensions are 7.1 mm×3.55 mm. When the frequency band is equal to or higher than 40 GHz, the long side x short side become as small as 5.7 mm ×2.85 mm or less.

However, as described above, the flexible waveguide mounted in a satellite must have a mechanical strength high enough to withstand a random wave vibration level of 19.6 grms.

Therefore, when a flexible waveguide to be used in a millimeter wave frequency band exceeding 40 GHz is to be mounted in a satellite, a flexible waveguide which has a small aperture size and a sufficient mechanical strength must be realized, or a waveguide which has a sufficient mechanical strength and large dimensions must be used for the millimeter wave frequency band without any modifications.

However, it is very difficult to manufacture a flexible waveguide which has a small aperture size corresponding to the millimeter wave frequency band, and has a mechanical strength high enough to withstand a use in a satellite, and such a waveguide has not been realized yet.

When the conventional flexible waveguide assembly is used in the millimeter wave frequency band equal to or higher than 40 GHz, a transmission loss of a radio wave at a frequency of 43 GHz or higher and a transmission loss deviation in a frequency bandwidth of 200 MHz become too large for practical applications, as shown in FIG. 3. The measurement results were a transmission loss of 1.5 dB, and a transmission loss deviation of 1.3 dB in the frequency bandwidth of 200 MHz.

The performance generally required for a flexible waveguide assembly includes a transmission loss of 0.5 dB or less and a transmission loss deviation of 0.2 dB or less in the frequency bandwidth of 200 MHz. Thus, the performance of the conventional flexible waveguide assembly in the millimeter wave frequency band is considerably inferior to the required performance, and cannot be put into a practical application.

SUMMARY OF THE INVENTION

The present invention has been made in consideration of the above situation, and has as its object to provide a waveguide which has sufficient transmission performance in a frequency band exceeding 40 GHz, and also has a mechanical strength high enough to withstand a use in, e.g., a satellite.

In order to achieve the above object, according to the first aspect of the present invention, there is provided a waveguide for transmitting an electromagnetic wave in a frequency band equal to or higher than 40 GHz, comprising a main waveguide portion for transmitting an electromagnetic wave in a frequency band equal to or lower than 40 GHz, and a stub circuit portion, connected in series with the main waveguide portion, for attaining impedance matching.

According to the second aspect of the present invention, there is provided a waveguide, wherein the main waveguide portion described in the first aspect comprises a flexible waveguide.

In order to achieve the above object, according to the third aspect of the present invention, there is provided a waveguide assembly for transmitting an electromagnetic wave in a predetermined frequency band or higher, which comprises a main waveguide portion for transmitting an electromagnetic wave in the predetermined frequency band or lower, and rectangular waveguides connected to the two ends of the main waveguide portion, comprising a stub circuit portion having an inner shape defined by forming a gap in at least one long side portion of at least one rectangular waveguide, and elongating the gap.

According to the fourth aspect of the present invention, there is provided a waveguide, wherein a distal end portion of the stub circuit portion described in the third aspect is short-circuited.

According to the fifth aspect of the present invention, there is provided a waveguide, wherein the stub circuit portion described in the fourth aspect has an inner shape defined by elongating the gap formed in the long side portion of the rectangular waveguide in a direction perpendicular to the rectangular waveguide.

According to the sixth aspect of the present invention, there is provided a waveguide, wherein the stub circuit portion described in the fourth aspect has an inner shape defined by elongating the gap formed in the long side portion of the rectangular waveguide in a direction parallel to the rectangular waveguide.

According to the seventh aspect of the present invention, there is provided a waveguide, wherein a distal end portion of the stub circuit portion described in the third aspect is open.

According to the eighth aspect of the present invention, there is provided a waveguide, wherein the stub circuit portion described in the seventh aspect has an inner shape defined by elongating the gap formed in the long side portion of the rectangular waveguide in a direction perpendicular to the rectangular waveguide.

According to the ninth aspect of the present invention, there is provided a waveguide, wherein the main waveguide portion described in any one of the third to eighth aspects comprises a flexible waveguide.

Furthermore, in order to achieve the above object, according to the tenth aspect of the present invention, there is provided a flexible waveguide assembly which is suitable for electromagnetic wave transmission in a predetermined frequency band or higher and comprises a flexible waveguide portion and rectangular waveguide portions connected to the two ends of the flexible waveguide portion, wherein the flexible waveguide has an aperture size suitable for electromagnetic wave transmission in the predetermined frequency band or higher, and at least one of the rectangular waveguides has a stub circuit for achieving impedance matching upon being connected in series with the flexible waveguide portion.

As is apparent from the above-mentioned aspects, the waveguide according to the present invention can have a sufficiently high mechanical strength for a use in a satellite since a stub circuit portion for achieving impedance matching is connected in series with a waveguide portion used in transmission in a relatively low frequency band. In addition, the impedance characteristics of the waveguide can be improved, and sufficient transmission performance can be attained even in a high frequency band, e.g., in a millimeter wave frequency band exceeding 40 GHz.

When the conventional waveguide having no stub circuit portion is used in the millimeter wave frequency band, the transmission performance yields a transmission loss of 1.5 dB, and a transmission loss deviation of 1.3 dB in the frequency bandwidth of 200 MHz, while when the waveguide having the stub circuit portion is used in the millimeter wave frequency band, the transmission performance yields a transmission loss of 0.3 dB, and a transmission loss deviation of 0.0 dB, and can be remarkably improved.

The above and many other advantages, features and additional objects of the present invention will become manifest to those versed in the art upon making reference to the following detailed description and accompanying drawings in which preferred structural embodiments incorporating the principles of the present invention are shown by way of illustrative example.

DETAILED DESCRIPTION OF THE PREFERRED EMBODIMENTS

The present invention will be described in more detail hereinafter with reference to some preferred embodiments illustrated in the accompanying drawings (FIGS. 4 to 12).

Figure 4:
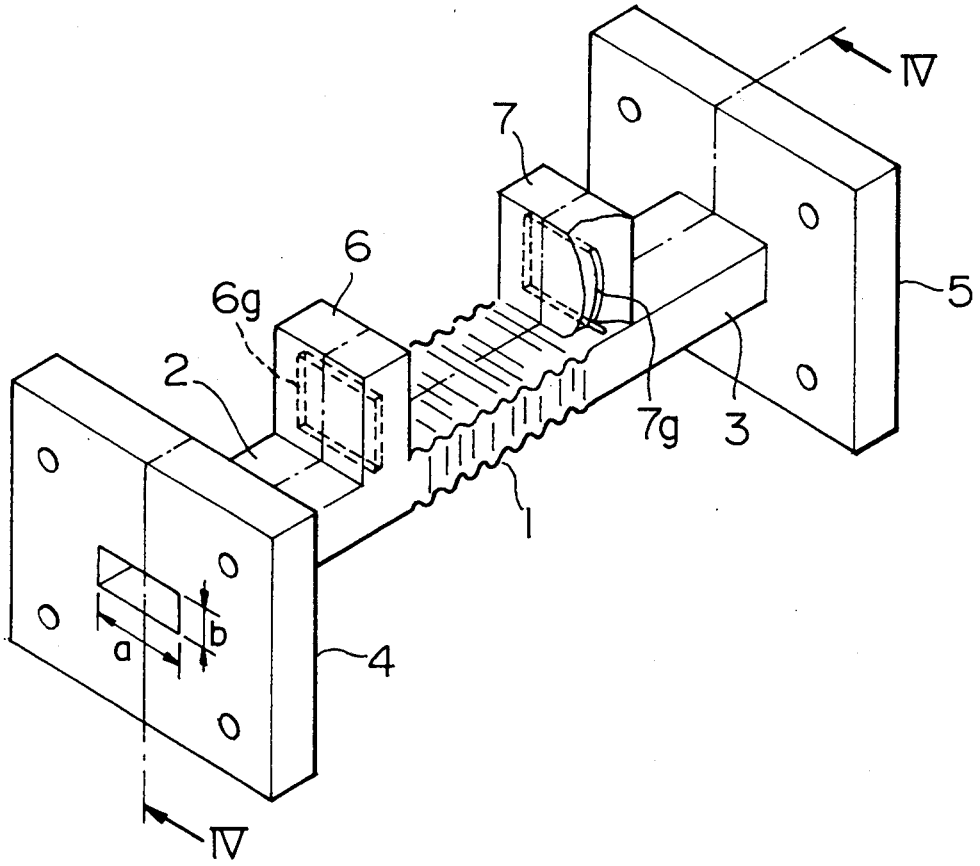
FIG. 4 is a partially cutaway schematic perspective view of a flexible waveguide assembly according to the first embodiment of the present invention.
Figure 5:
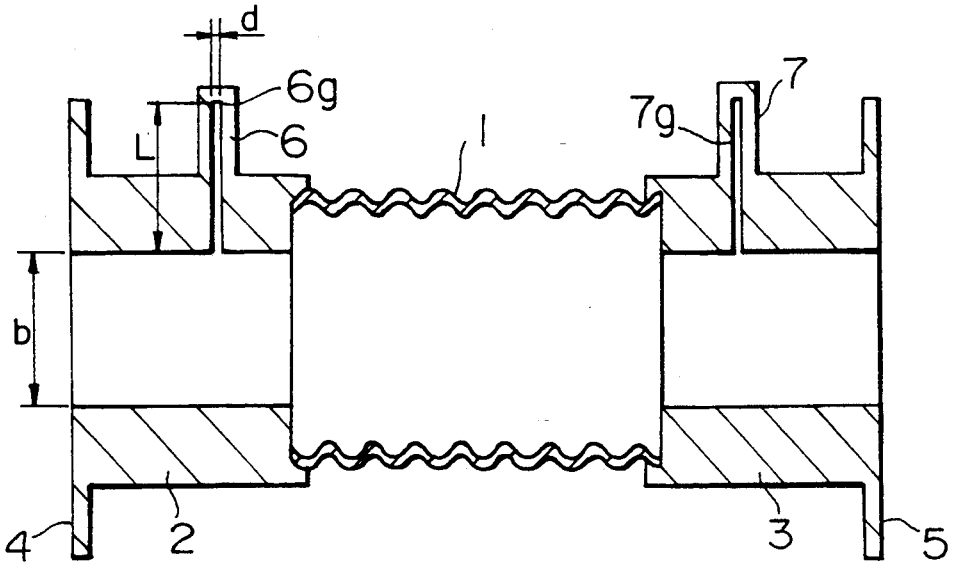
FIG. 5 is a sectional view taken along a line IV—IV in FIG. 4.

FIG. 4 is a partially cutaway schematic perspective view of a flexible waveguide assembly according to the first embodiment of the present invention, and FIG. 5 is a sectional view taken along a line IV—IV in FIG. 4.

As shown in FIG. 4, rectangular waveguides 2 and 3, and waveguide flanges 4 and 5 are respectively connected to the two ends of a flexible waveguide 1 via stub circuit portions 6 and 7. The flexible waveguide 1 has dimensions suitable for a use in a 30-GHz band.

Note that the stub circuit portion 7 in FIG. 4 is partially cutaway for the sake of descriptive convenience.

The stub circuit portions 6 and 7 have structures defined by elongating gaps formed in the long side portions of the rectangular waveguides 2 and 3 in the direction perpendicular to the rectangular waveguides, and short-circuiting their distal end portions. Therefore, inner spaces 6*g* and 7*g* of the stub circuit portions 6 and 7 communicate with the interior of the rectangular waveguides 2 and 3 via small gaps.

A length L of each of the inner spaces 6*g* and 7*g* of the stub circuit portions 6 and 7 is defined to be the distance from the inner wall of the long side portion of each of the rectangular waveguides 2 and 3 to the inner space distal end portion, and is selected to be $\frac{1}{4}$ of a guide wavelength $\lambda g$ passing through the waveguide.

Alternatively, the length L may be given by:

$$L=(n/2+\tfrac{1}{4})\,\lambda g$$

(n is an integer)

In this case, for example, the gap d=0.2 mm and L=4.3 mm.

Figure 6:
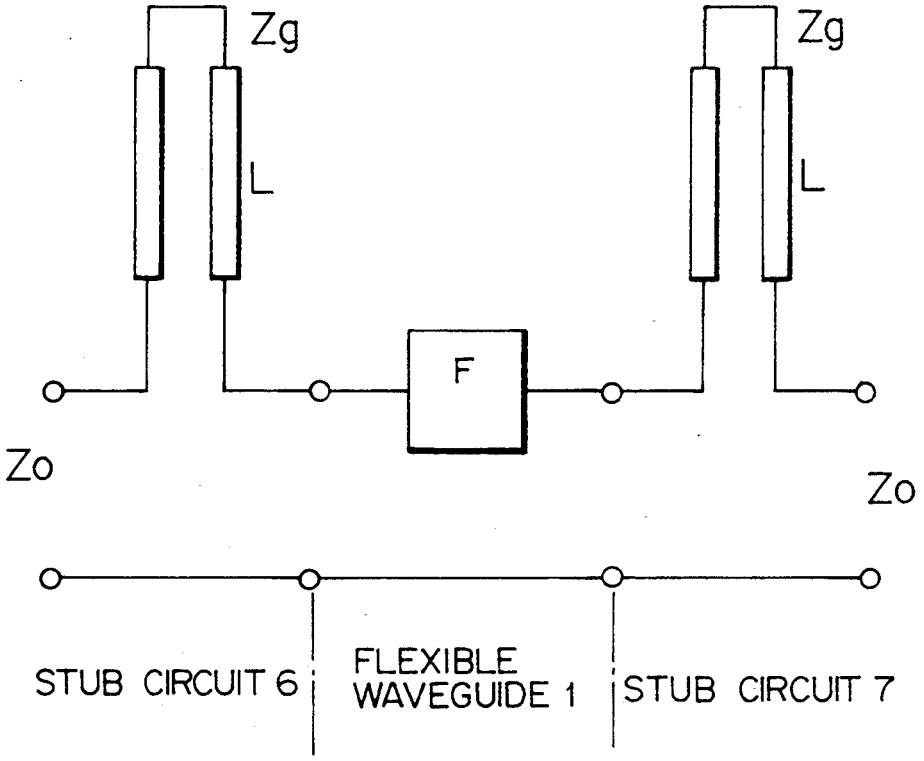
FIG. 6 is an equivalent circuit diagram of the first embodiment shown in FIGS. 4 and 5.

FIG. 6 is an equivalent circuit diagram of this embodiment.

As shown in FIG. 6, the stub circuit portions 6 and 7 with the above-mentioned structures constitute circuits connected in series with the flexible waveguide 1.

The stub circuit portion has a low impedance. For example, when the gap d=0.2 mm and the length L=4.3 mm, an impedance Zg of the stub circuit portion is given by $0.070\times Zo$ (where Zo is the normalized impedance of the waveguide).

Figure 7:
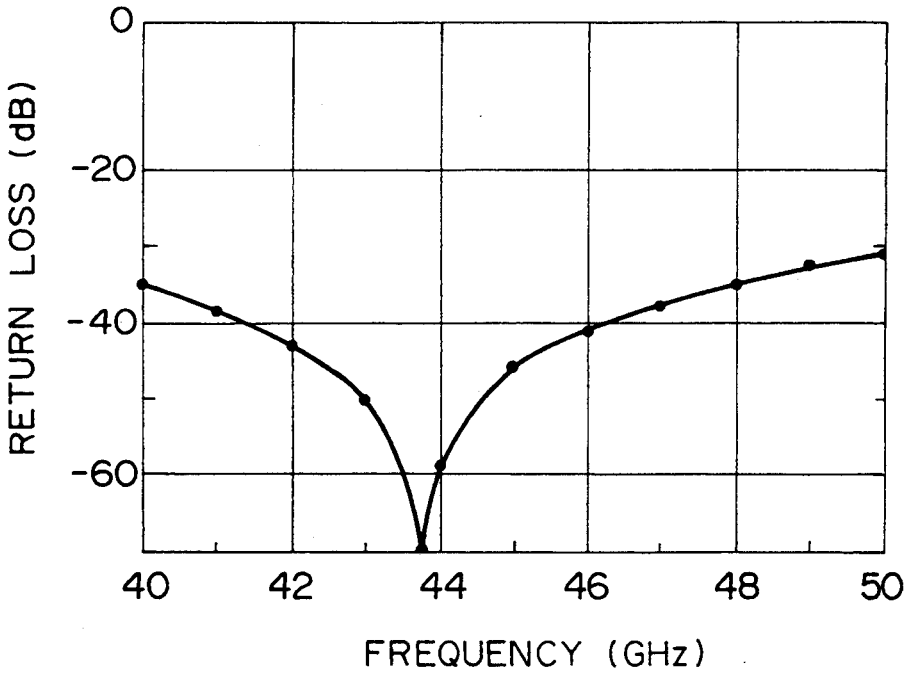
FIG. 7 is a graph showing the return loss of a stub circuit portion alone in FIG. 6.

FIG. 7 is a graph showing the return loss characteristics of the stub circuit portion alone in FIG. 6.

As shown in FIG. 7, the return loss of the stub circuit portion is −70 dB at 43.8 GHz, and is −43 dB or less in a range, from 42 to 44 GHz. Thus, as can be understood from FIG. 7, impedance matching is sufficiently achieved.

It is considered that the impedance matching improvement characteristics of the stub circuit portion compensate for a stray reactance generated in the flexible waveguide. Therefore, when the stub circuit portion is connected in series with the flexible waveguide, the transmission loss characteristics of the waveguide can be remarkably improved, as will be described below.

Figure 8:
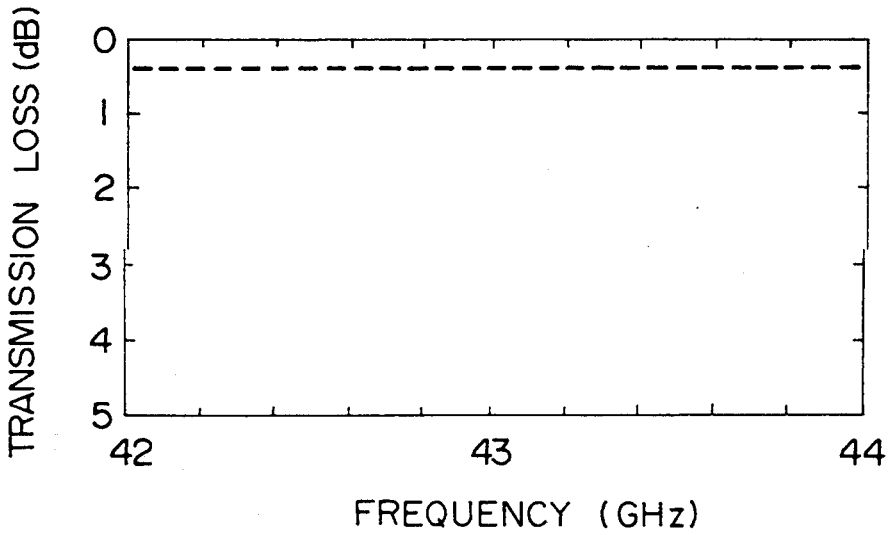
FIG. 8 is a graph showing the transmission loss characteristics with respect to the frequency in the first embodiment.

FIG. 8 is a graph showing the transmission loss characteristics of this embodiment.

Figure 1:
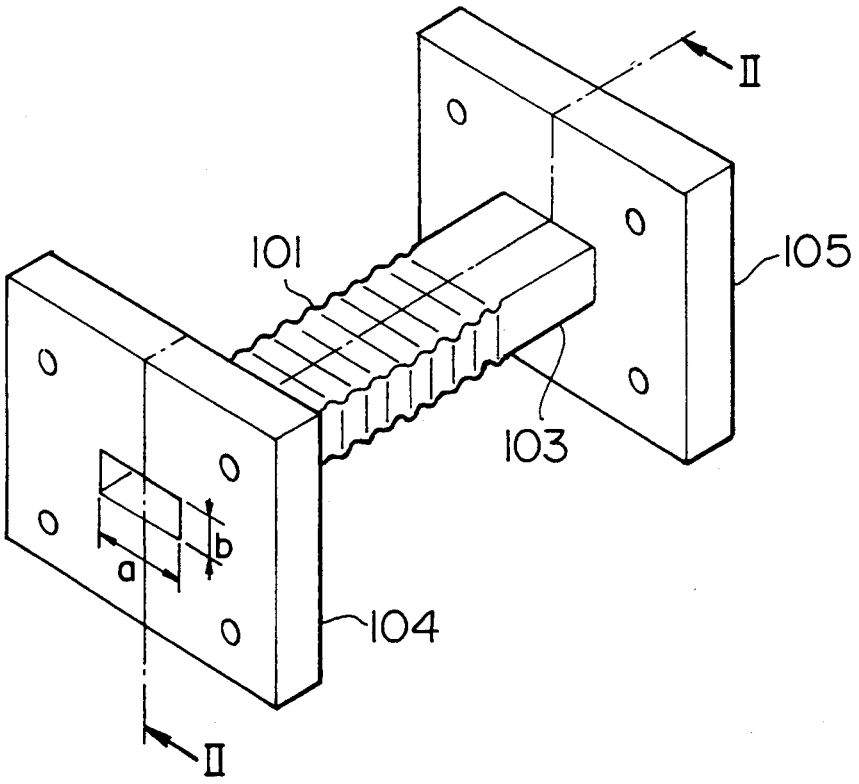
FIG. 1 PRIOR ART
FIG. 1 is a partially cutaway schematic perspective view of a conventional flexible waveguide assembly.
Figure 2:
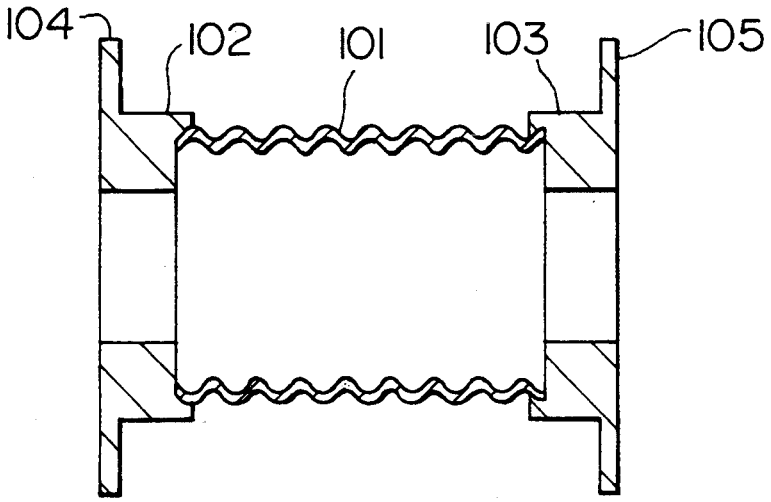
FIG. 2 PRIOR ART
FIG. 2 is a sectional view taken along a line II—II in FIG. 1.
Figure 3:
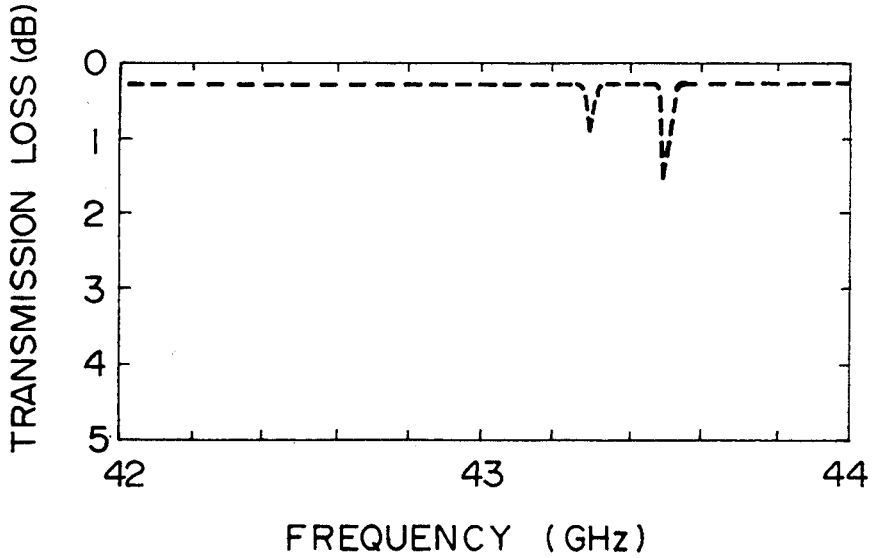
FIG. 3 PRIOR ART
FIG. 3 is a graph showing the transmission loss characteristics with respect to the frequency in the prior art.

As can be seen from FIG. 8, a deterioration phenomenon of the transmission loss characteristics (see FIG. 3), which occurs at frequencies near 43.3 GHz and 43.5

GHz, is eliminated by the present invention. In this embodiment, the transmission loss is 0.3 dB and the transmission loss deviation in the frequency bandwidth of 200 MHz is 0.0 dB, thus satisfying the above-mentioned required performance of the flexible waveguide.

As described above, since an unnecessary mode generated in the flexible waveguide can be suppressed by the stub circuit portions, a waveguide which can be used in a higher frequency band, e.g., a millimeter wave frequency band exceeding 40 GHz, can be realized using a flexible waveguide which has a high mechanical strength and for use in, e.g., a 30-GHz band.

Figure 9:
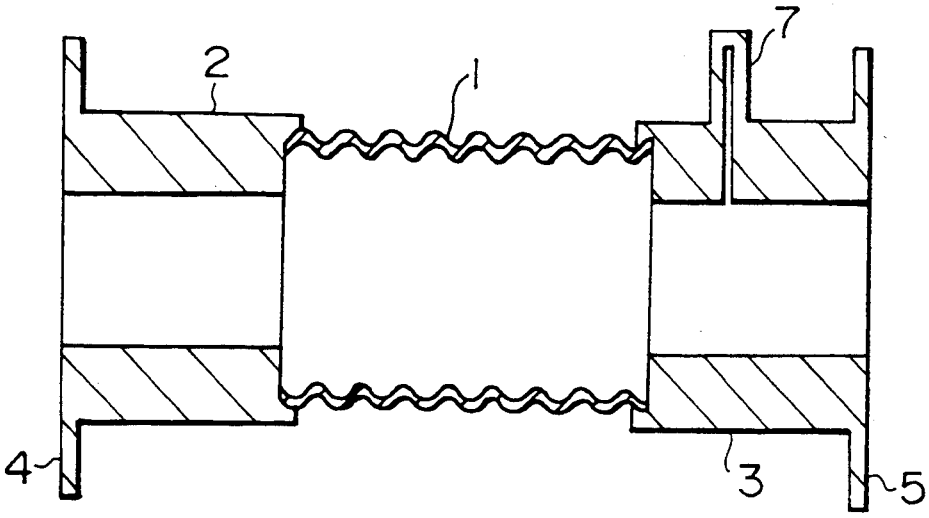
FIGS. 9 to 12 are sectional views showing the second to fifth embodiments of the present invention.

FIG. 9 is a sectional view of a flexible waveguide assembly according to the second embodiment of the present invention.

In this embodiment, the stub circuit portion 7 is provided to only one rectangular waveguide 3. With this arrangement, since the stub circuit portion 7 is connected in series with the flexible waveguide portion 1, an unnecessary mode of the flexible waveguide 1 can be suppressed.

Figure 10:
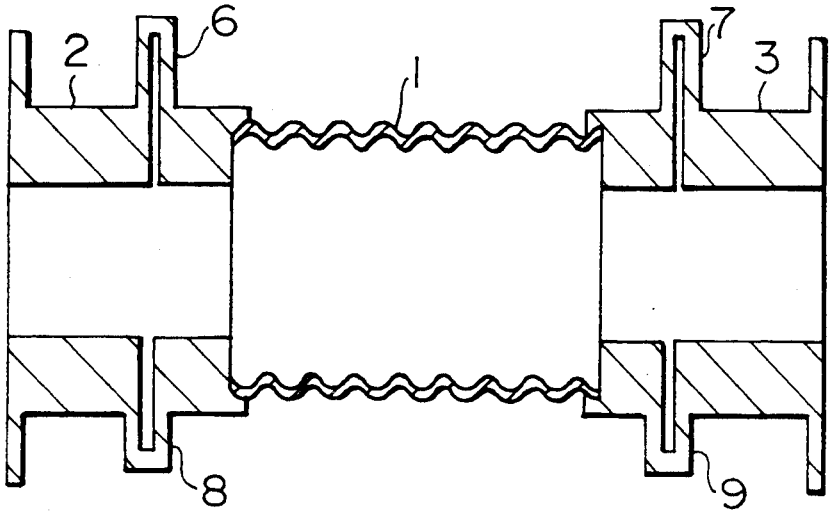

FIG. 10 is a sectional view showing the third embodiment of the present invention.

As shown in FIG. 10, when the stub circuit portions 6 and 7, and stub circuit portions 8 and 9 are respectively formed on the two long side portions of the rectangular waveguides 2 and 3, the same effect as described above can be obtained.

Figure 11:
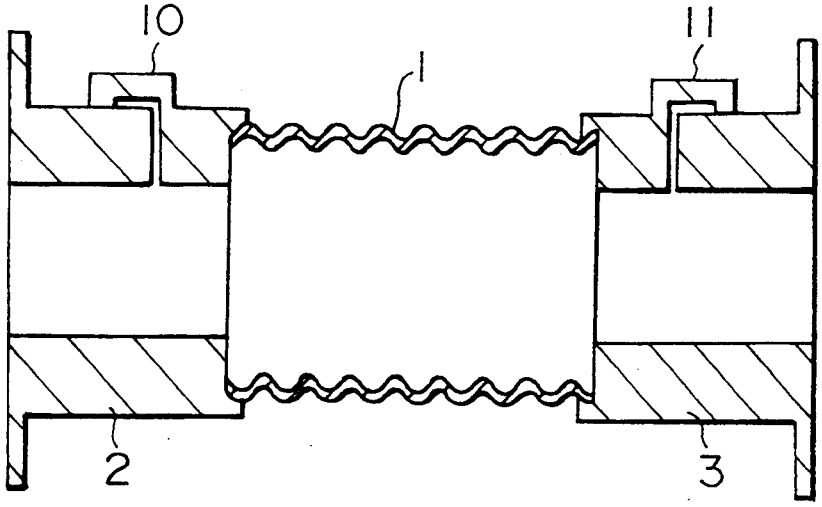

Also, as shown in FIG. 11, when stub circuit portions 10 and 11 are bent in a direction parallel to the surfaces of the rectangular waveguides 2 and 3 as the fourth embodiment of the present invention, the same effect can be obtained. In this embodiment, since the stub circuit portions do not project, an extra advantage can be expected.

Figure 12:
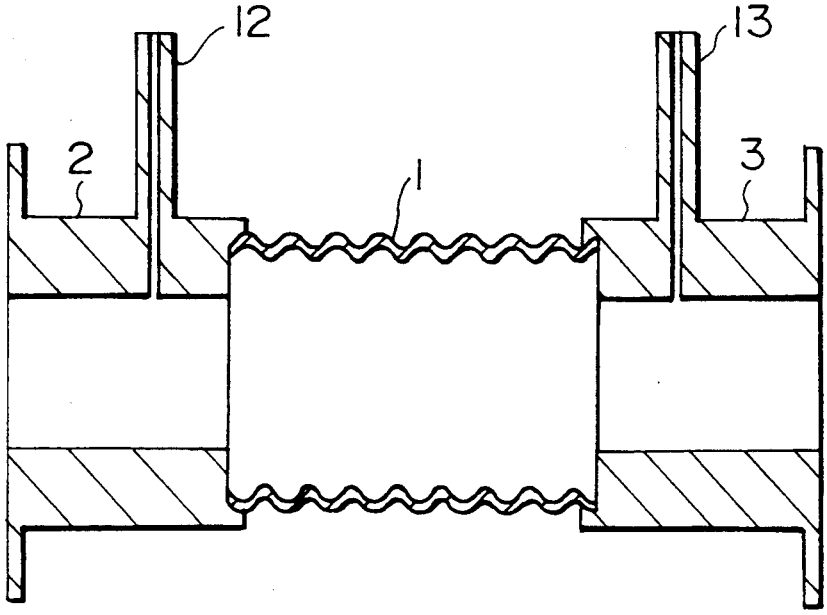

FIG. 12 is a sectional view showing the fifth embodiment of the present invention.

In this embodiment, stub circuit portions 12 and 13 with open distal end portions are formed. In this case, the length L of the stub circuit portion is selected to be $L=\frac{1}{2}\times\lambda g\ n$ (n is an integer) since a circuit obtained by short-circuiting the distal end by a length $\lambda g/4$ shown in FIG. 6 is equivalent to a circuit obtained by opening the distal end by a length $\lambda g/2$ in this embodiment.

What is claimed is:

1. A waveguide for transmitting an electromagnetic wave in a frequency band not less than a predetermined frequency, comprising: a main waveguide portion for transmitting an electromagnetic wave in a frequency band not more than the predetermined frequency; a second waveguide connected to the main waveguide portion for transmitting an electromagnetic wave in a frequency band not less than the predetermined frequency, and a stub circuit portion, connected in series with said main waveguide portion through said second waveguide, for attaining impedance matching in a frequency band not less than the predetermined frequency.

2. A waveguide according to claim 1, wherein said main waveguide portion comprises a flexible waveguide.

3. A waveguide according to claim 1, wherein said predetermined frequency is 40 GHz.

4. A waveguide according to claim 1 wherein said second waveguide is rectangular in shape.

5. A waveguide according to claim 1, wherein said second waveguide has a smaller aperture therethrough than said main waveguide portion.

6. A waveguide according to claim 1, wherein said second waveguide is connected to one end of said main waveguide portion and a third waveguide is connected to the other end of said main waveguide portion.

7. A waveguide assembly for transmitting an electromagnetic wave in a frequency band not less than a predetermined frequency, which comprises: a main waveguide portion for transmitting an electromagnetic wave in a frequency band not more than the predetermined frequency, and rectangular waveguides connected to two ends of said main waveguide portion so as to transmit an electromagnetic wave in a frequency band not less than the predetermined frequency, and a stub circuit portion having an inner shape defined by forming a gap in at least one long side portion of at least one rectangular waveguide, and thereby extending the aperture of said rectangular waveguide.

8. A waveguide according to claim 7, wherein a distal end portion of said stub circuit portion is short-circuited.

9. A waveguide according to claim 8, wherein said main waveguide portion comprises a flexible waveguide.

10. A waveguide according to claim 8, wherein said stub circuit portion has an inner shape defined by elongating the gap formed in the long side portion of the rectangular waveguide in a direction perpendicular to the rectangular waveguide.

11. A waveguide according to claim 10, wherein said main waveguide portion comprises a flexible waveguide.

12. A waveguide according to claim 8, wherein said stub circuit, portion has an inner shape defined by elongating the gap formed in the long side portion of the rectangular waveguide in a direction parallel to the rectangular waveguide.

13. A waveguide according to claim 12, wherein said main waveguide portion comprises a flexible waveguide.

14. A waveguide according to claim 7, wherein a distal end portion of,said stub circuit portion is open.

15. A waveguide according to claim 14, wherein said main waveguide portion comprises a flexible waveguide.

16. A waveguide according to claim 14, wherein said stub circuit portion has an inner shape defined by elongating the gap formed in the long side portion of the rectangular waveguide in a direction perpendicular to the rectangular waveguide.

17. A waveguide according to claim 16, wherein said main waveguide portion comprises a flexible waveguide.

18. A waveguide according to claim 7, wherein said main waveguide portion comprises a flexible waveguide.

19. A flexible waveguide assembly which is suitable for electromagnetic wave transmission in a frequency band not less than a predetermined frequency, comprises: a flexible waveguide portion and first and second rectangular waveguide portions connected respectively to two ends of said flexible waveguide portion, wherein the flexible waveguide has an aperture size suitable for electromagnetic wave transmission in a frequency band not more than the predetermined frequency, the first and second rectangular waveguide portions being suitable for electromagnetic wave transmissions in a frequency band not less than the predetermined frequency, and at least one of said first and second rectangular waveguides has a stub circuit portion connected in series with said flexible waveguide portion for achieving impedance matching in the frequency band not less than the predetermined frequency.

* * * * *